US009190230B2

(12) United States Patent
Johnson et al.

(10) Patent No.: US 9,190,230 B2
(45) Date of Patent: Nov. 17, 2015

(54) GROUNDING SWITCH

(75) Inventors: Charles W. Johnson, Wytheville, VA (US); Samuel S. Outten, Washington, DC (US); Claudio Ibarra, Christiansburg, VA (US); Charlie Sarver, Rocky Gap, VA (US)

(73) Assignee: ABB Technology AG, Zurich (CH)

( * ) Notice: Subject to any disclaimer, the term of this patent is extended or adjusted under 35 U.S.C. 154(b) by 259 days.

(21) Appl. No.: 13/477,554

(22) Filed: May 22, 2012

(65) Prior Publication Data

US 2012/0300358 A1 Nov. 29, 2012

Related U.S. Application Data

(60) Provisional application No. 61/490,704, filed on May 27, 2011.

(51) Int. Cl.

| | |
|---|---|
| ***H01H 3/02*** | (2006.01) |
| ***H01F 41/00*** | (2006.01) |
| ***H01H 31/00*** | (2006.01) |
| ***H01H 3/40*** | (2006.01) |
| ***H01H 3/58*** | (2006.01) |

(52) U.S. Cl.

CPC ..... *H01H 31/003* (2013.01); *H01H 3/40* (2013.01); *H01H 3/58* (2013.01); *Y10T 29/49073* (2015.01)

(58) Field of Classification Search

CPC ..... H01H 3/40; H01H 3/58; H01H 31/003; Y10T 29/49073

USPC ..... 361/268

See application file for complete search history.

(56) References Cited

U.S. PATENT DOCUMENTS

| | | | | |
|---|---|---|---|---|
| 2,820,862 | A | 1/1958 | Carmichael et al. | |
| 3,243,538 | A * | 3/1966 | Rodeseike | 200/472 |
| 4,772,806 | A * | 9/1988 | Lean et al. | 307/38 |
| 4,922,405 | A * | 5/1990 | Foll et al. | 363/126 |

(Continued)

FOREIGN PATENT DOCUMENTS

| | | |
|---|---|---|
| DE | 4436118 A1 | 3/1996 |
| EP | 2073332 A1 | 6/2009 |
| WO | 2008001589 | 1/2008 |

OTHER PUBLICATIONS

European Patent Office, International Search Report WO PCT/US2012/038980 dated May 22, 2012, pp. 1-7 and having a mail date of Nov. 27, 2012 in U.S. Appl. No. 13/477,554, Charles W. Johnson et al.

(Continued)

*Primary Examiner* — Thienvu Tran
*Assistant Examiner* — Kevin J Comber
(74) *Attorney, Agent, or Firm* — Melissa J. Szczepanik

(57) ABSTRACT

A grounding switch is comprised of a structural frame, at least one first contact, at least one second contact, at least one spacer, and a geared drive assembly. The opening and closing of the grounding switch is controlled by the geared drive assembly. The geared drive assembly is operable to rotate the at least one second contact around the axis of a connecting rod to move the at least one second contact into and out of contact with the at least one first contact. The closing of the grounding switch first and second contacts serve to connect a transformer or other electrical device to ground potential.

16 Claims, 7 Drawing Sheets

(56) References Cited

U.S. PATENT DOCUMENTS

| | | | | |
|---|---|---|---|---|
| 5,321,221 | A * | 6/1994 | Rozier | 218/2 |
| 8,068,320 | B2 * | 11/2011 | Faulkner et al. | 361/62 |
| 2005/0189326 | A1 * | 9/2005 | Moser et al. | 218/118 |
| 2006/0254890 | A1 | 11/2006 | Yu | |
| 2012/0273333 | A1 * | 11/2012 | Miller | 200/400 |

OTHER PUBLICATIONS

European Patent Office, International Search Report WO PCT/us2012/038980 dated May 22, 2012, pp. 1-5 and having a mail date of Sep. 3, 2012 in U.S. Appl. No. 13/477,554, Charles W. Johnson et al.

* cited by examiner

GROUNDING SWITCH

CROSS-REFERENCE TO RELATED APPLICATION

This application claims the benefit of U.S. provisional patent application No. 61/490,704 filed on May 27, 2011, which is hereby incorporated by reference in its entirety.

FIELD OF INVENTION

The present application is directed to a grounding switch for a dry-type transformer that includes a drive assembly used in the operation of the grounding switch.

BACKGROUND

Grounding switches are used in dry-type transformer applications to connect the transformer to ground potential. The primary terminals of the transformer are normally grounded during installation, maintenance and other events through the use of the grounding switch. Typical dry-type grounding switches have a fairly large footprint whether they are located inside or external to a transformer enclosure. The large footprint is due to the size of a drive assembly integrated within the grounding switch. The drive assembly often comprises long connecting rods that are used to open and close the contacts of the grounding switch. When the grounding switch is located inside the transformer enclosure, the size of the transformer enclosure must be increased to accommodate the grounding switch having such a drive assembly. If the grounding switch is externally located, the overall external footprint of the transformer with the grounding switch is relatively large. Therefore, there is room for improvement in grounding switches and more particularly, drive assemblies utilized in grounding switches. The present application is directed to an improved grounding switch with a smaller footprint and providing ease of operation.

SUMMARY

A grounding switch assembly for a power distribution device has a structural frame, at least one spacer connected to the structural frame, at least one switch connected to the at least one spacer wherein each switch has first and second contacts, and a drive assembly that is operably connected to the at least one switch to move the at least one switch between open and closed positions. The drive assembly is comprised of at least one rod, a drive shaft, a drive box, and at least one mount. The drive box is connected between the drive shaft and the at least one rod and is operable to translate rotation of the drive shaft into rotation of the at least one rod. The at least one mount is secured to the at least one rod and holds the second contact of each switch. The rotation of the at least one rod causes the second contact of each switch to pivot and thereby move each switch toward the open position or the closed position.

A transformer comprises a ferromagnetic core having at least one limb extending between first and second yokes, at least one coil assembly mounted to the at least one limb, an enclosure having at least one wall, a lid and a base, and a grounding switch. The grounding switch is operable to connect the transformer to a ground connection when the at least one second contact of the grounding switch is moved into contact with the at least one first contact of the grounding switch.

A method of forming a transformer comprises providing a ferromagnetic core comprising at least one limb extending between first and second yokes, mounting at least one coil assembly to the at least one limb, placing the ferromagnetic core and the at least one coil assembly into an interior space of an enclosure, and mounting a grounding switch to the interior space of the enclosure, the grounding switch operable to connect the transformer to ground potential.

BRIEF DESCRIPTION OF THE DRAWINGS

In the accompanying drawings, structural embodiments are illustrated that, together with the detailed description provided below, describe exemplary embodiments of a grounding switch. One of ordinary skill in the art will appreciate that a component may be designed as multiple components or that multiple components may be designed as a single component.

Further, in the accompanying drawings and description that follow, like parts are indicated throughout the drawings and written description with the same reference numerals, respectively. The figures are not drawn to scale and the proportions of certain parts have been exaggerated for convenience of illustration.

DETAILED DESCRIPTION

Figure 1:
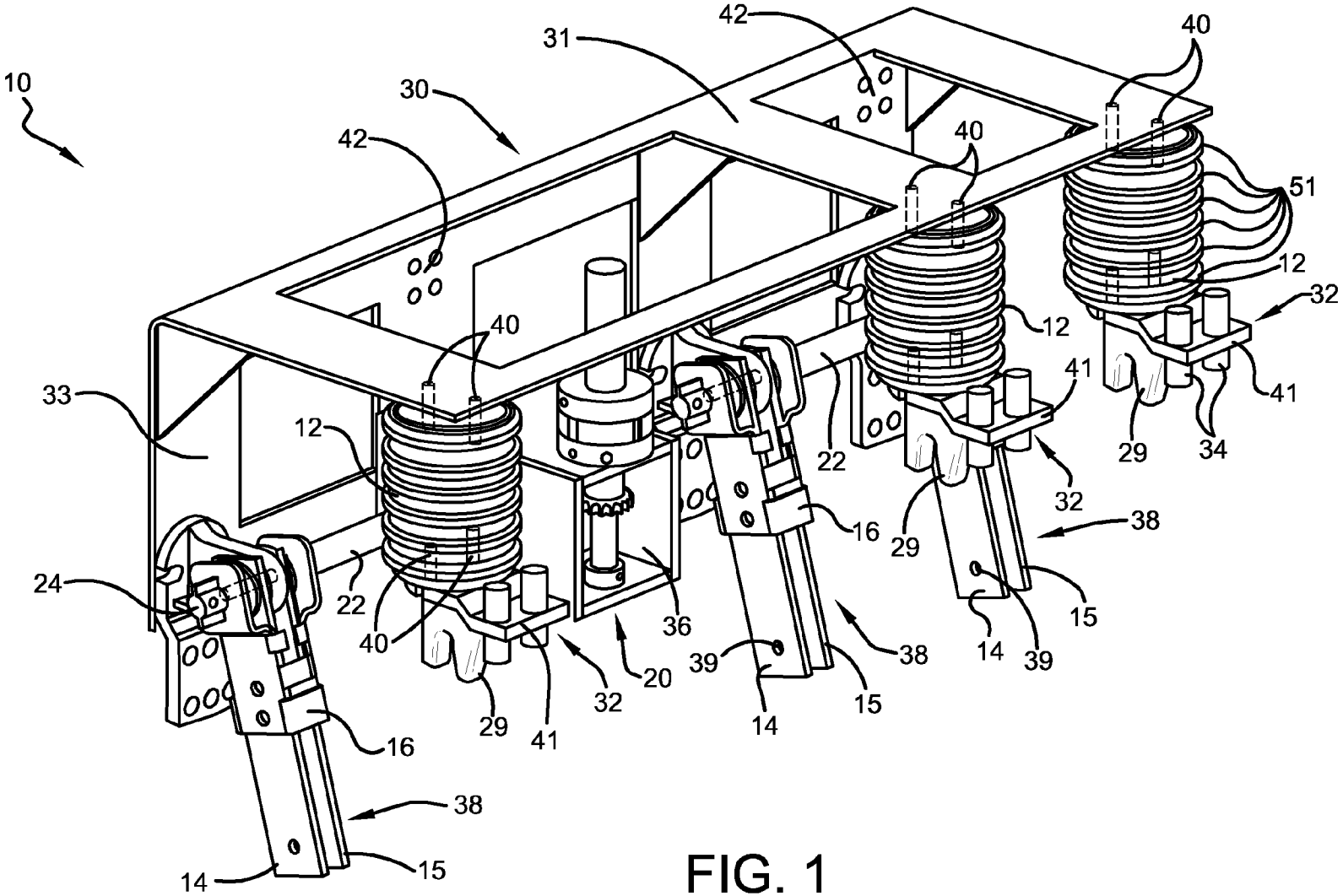
FIG. 1 is an isometric view of a grounding switch embodied in accordance with the present invention wherein at least one first contact and at least one second contact are depicted in an open position.

Referring to FIG. 1, a grounding switch 10 is shown having an integral geared drive assembly 20. The grounding switch 10 may be provided as a single-phase or poly-phase switch, suitable for medium-voltage and high-voltage applications. The grounding switch 10 is comprised of at least one switch having first and second contacts 32, 38. The grounding switch 10 is typically provided with a dry-type transformer 80 but may also be used with gas-insulated switchgear or another electrical device that may be used in power distribution.

Figure 6:
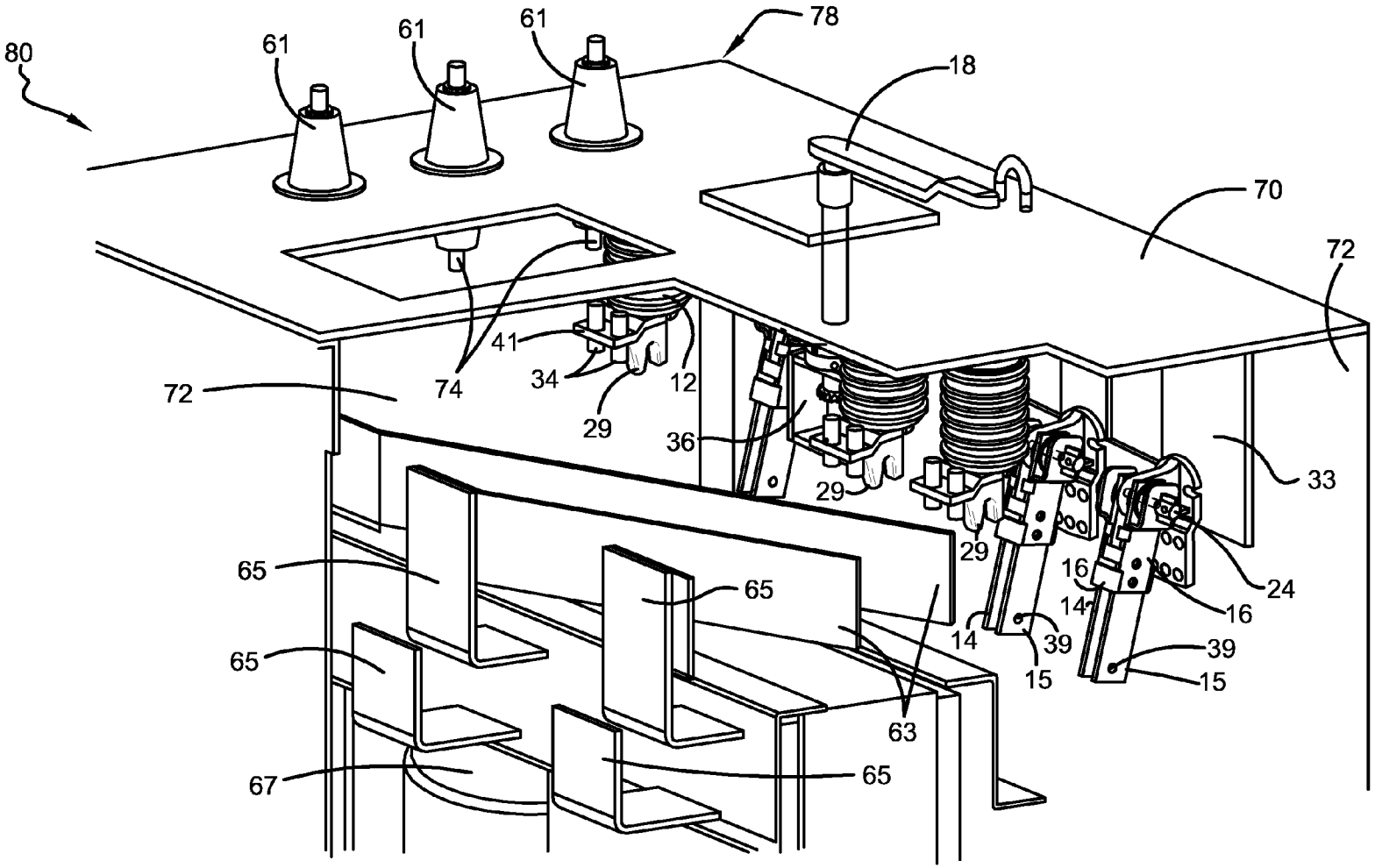
FIG. 6 is a perspective view of a transformer with a front wall, a side wall, and a portion of a lid removed from the enclosure of the transformer wherein the at least one first contact and the at least one second contact are depicted in an open position.

Referring now to FIGS. 1 and 6, the grounding switch 10 is comprised of a structural frame 30 that is generally L-shaped having a first side 31 and a second side 33, a geared drive assembly 20, at least one first contact 32, at least one second contact 38, and at least one spacer 12. The structural frame 30 may be formed of a metal, clad metal, or any other conductive or non-conductive material suitable for the application. One having ordinary skill in the art will recognize that the structural frame 30 may also comprise a wall 72 of a transformer enclosure 78, a lid 70 or top cover of a transformer enclosure 78, a combination wherein a wall 72 serves as a first side of the structural frame 30 and a bottom planar surface of the lid 70 serves as a second side of the frame or another arrangement. The grounding switch 10 may be attached to the transformer 80 using bolted or welded connections 42. The transformer enclosure 78 may also be provided with hooks for attaching the grounding switch 10 to the enclosure 78.

When the grounding switch 10 is attached to a wall 72 of the dry-type transformer 80 (hereinafter "transformer") enclosure 78, an outer planar surface of the first side 31 of the structural frame 30 may extend horizontally from the wall 72 of the enclosure 78 at a position of about 1.25 centimeters from a top edge portion of the wall 72. In the same mounting arrangement, a second side 33 of the structural frame 30 may extend along an interior surface of the wall 72 wherein the second side of the structural frame is attached to the interior surface of the wall 72 using a bolted or welded connection 42.

The grounding switch 10 may also be located external to the transformer enclosure 78 whereby the grounding switch 10 may be mounted to an outside surface of a wall 72 of the transformer enclosure 78. Alternatively, the grounding switch may not be mounted to the transformer enclosure 78 in any manner.

Figure 7:
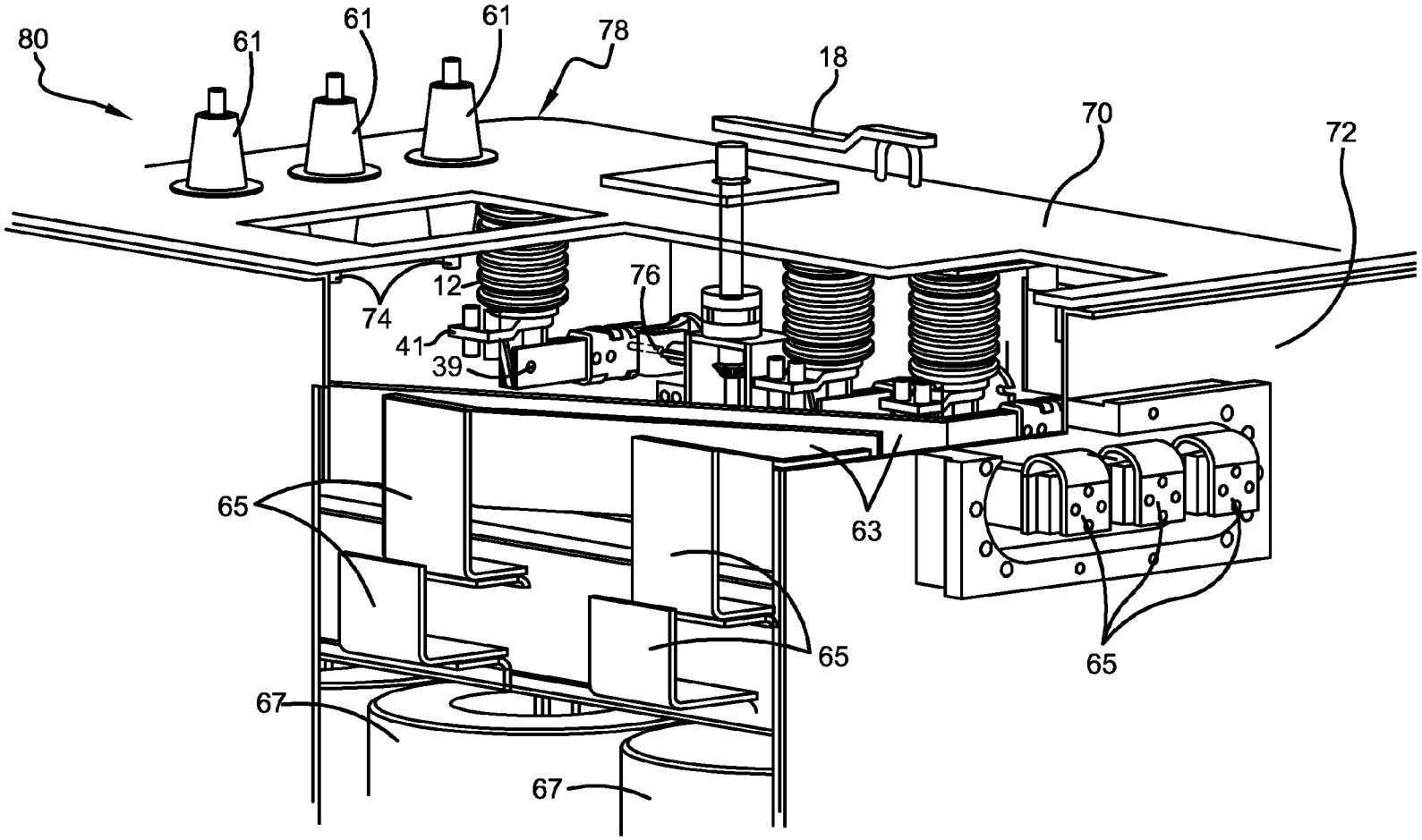
FIG. 7 is a perspective view of a transformer with a front wall and a portion of the lid removed from the enclosure of the transformer wherein the at least one first contact and the at least one second contact are depicted in a closed position.

Referring now to FIGS. 6 and 7, the transformer 80 has an enclosure 78 comprised of at least one wall 72, a base, and a lid 70. A ferromagnetic core having one or more limbs extending between a first yoke and a second yoke is disposed within the enclosure 78. One or more coil assemblies 67 are mounted to the one or more core limbs. The one or more coil assemblies 67 comprise high-voltage primary and low-voltage secondary coil windings. The high-voltage primary and low-voltage secondary coil windings are often arranged concentrically around each core limb. Other arrangements include the mounting of high-voltage primary and low-voltage secondary windings one above the other around each core limb or an interleaved arrangement having alternating high-voltage primary and low-voltage secondary windings mounted to the inner core limb. The high-voltage primary and low-voltage secondary coil windings of the present invention are comprised of a conductive material such as copper or aluminum. The high-voltage primary and low-voltage secondary windings may be vacuum-cast or resin-encapsulated.

The low-voltage secondary coil windings have low-voltage leads (not shown) that extend from the coils and may be connected together in a Delta or a Wye configuration. The low voltage leads are connected to a bus bar 63. In turn, the bus bar is connected to low-voltage terminations 65 which are rods of approximately one inch in diameter that originate inside the enclosure 78 and extend through the enclosure 78 as shown in FIG. 7.

Referring now to FIGS. 1, 3, 4 and 5, the grounding switch 10 may be connected to a primary, high-voltage side of the transformer 80 through the at least one first contact 32. The at least one first contact 32 is comprised of a flat metal plate 41 having at least one first opening 35, at least one second opening 37, and a forked extension portion 29 wherein the forked extension portion 29 extends perpendicularly from a bottom planar surface of the flat metal plate 41, toward the base of the enclosure 78. The forked extension portion 29 has a first leg and a second leg, each of which extend downward from the flat metal plate 41 of the at least one first contact 32.

There may be at least one spacer 12 attached to the at least one first contact 32 to provide insulation between the structural frame 30 and the at least one first contact 32. The at least one spacer 12 is generally cylindrical and may have a plurality of circumferentially-extending sheds 51. The at least one spacer 12 may be formed from a ceramic material or another material having similar insulating properties. The at least one spacer 12 is connected to the at least one first contact 32 using at least one bolt 40 that extends through the at least one second opening 37 of the flat metal plate 41 of the at least one first contact 32. The at least one bolt 40 extends about 1 inch inside an interior portion of the at least one spacer 12. The at least one bolt 40 also connects the at least one spacer 12 to a first side 31 of the structural frame 30.

At least one high-voltage lead (not shown) is connected to the plate 36 of the at least one first contact 32 by at least one first contact bolt 34 extending through the at least one first opening 35. The at least one high-voltage lead is comprised of a cable formed from copper or aluminum wire or a similar material. The at least one high-voltage lead has a first end and a second end comprised of a flat portion having an opening to receive the at least one first contact bolt 34. The at least one high-voltage lead is comprised of a first high-voltage lead and a second high-voltage lead. Each of the first high-voltage leads is connected at a first end to a corresponding one of the plates 41 of the at least one first contact 32 and is connected at a second end to a corresponding terminal 74 of a high-voltage bushing 61 of the transformer 80. Each of the second high-voltage leads is connected at a first end to a high-voltage coil of the transformer 80 and at a second end to a corresponding one of the plates 41 of the at least one first contact 32. The first high-voltage leads are secured to the at least one first contact 32 using the at least one first contact bolt 34 received by the at least one first opening of the at least one first contact 32. The at least one first contact bolt 34 is secured to the at least one first contact 32 using a washer and a nut that is threadably engaged with the at least one first contact bolt 34.

The at least one second contact 32 of the grounding switch is comprised of a first blade 14 and a second blade 15. The first and second blades 14, 15 are generally rectangular metal pieces that surround and grasp the forked extension portion 29 of the at least one first contact 32 when the at least one first and second contacts 38 are in full contact. The first and second blades 14, 15 are held in place and at a set distance apart with respect to one another using a first spring (not shown), a second spring (not shown), and a bolt (not shown). The first spring is placed on an outer portion of the first blade 14 and the second spring is placed on an outer portion of the second blade 15. The first and second blades each have an opening 39 that a center portion of the first and second springs, respectively, are placed over. The first and second blades are connected together using the bolt (not shown) wherein the bolt is placed through the associated opening 39. The bolt is secured by a washer and a nut. The first spring, the second spring, and the bolt provide a mechanism to maintain the first blade 14 at a set distance apart from the second blade 15.

A ground connection is formed at the at least one second contact 38 by the connection of the at least one second contact 38 to the wall 72 of the transformer enclosure 78. The grounding switch 10 may also connect the transformer 80 to ground potential using a ground connection other than the wall 72 of the transformer enclosure 78. For example, a ground connection may be run from another source that is at ground potential to the at least one second contact 38. When the first and second contacts 32, 38 are in full contact, the forked extension portion 29 of the at least one first contact 32 is fully engaged with a first blade 14 and a second blade 15 of the at least one second contact 38. The first and second legs of the forked extension portion 29 surround the bolt (not shown) when the forked extension portion 29 is disposed between the first and second blades 14, 15 of the at least one second contact 38. The grounding switch 10 is in a closed position when the first and second contacts 32, 38 are in full contact, thus, grounding the transformer 80. The grounding switch 10 is in an open position when the first and second contacts 32, 38 are separated.

Figure 2:
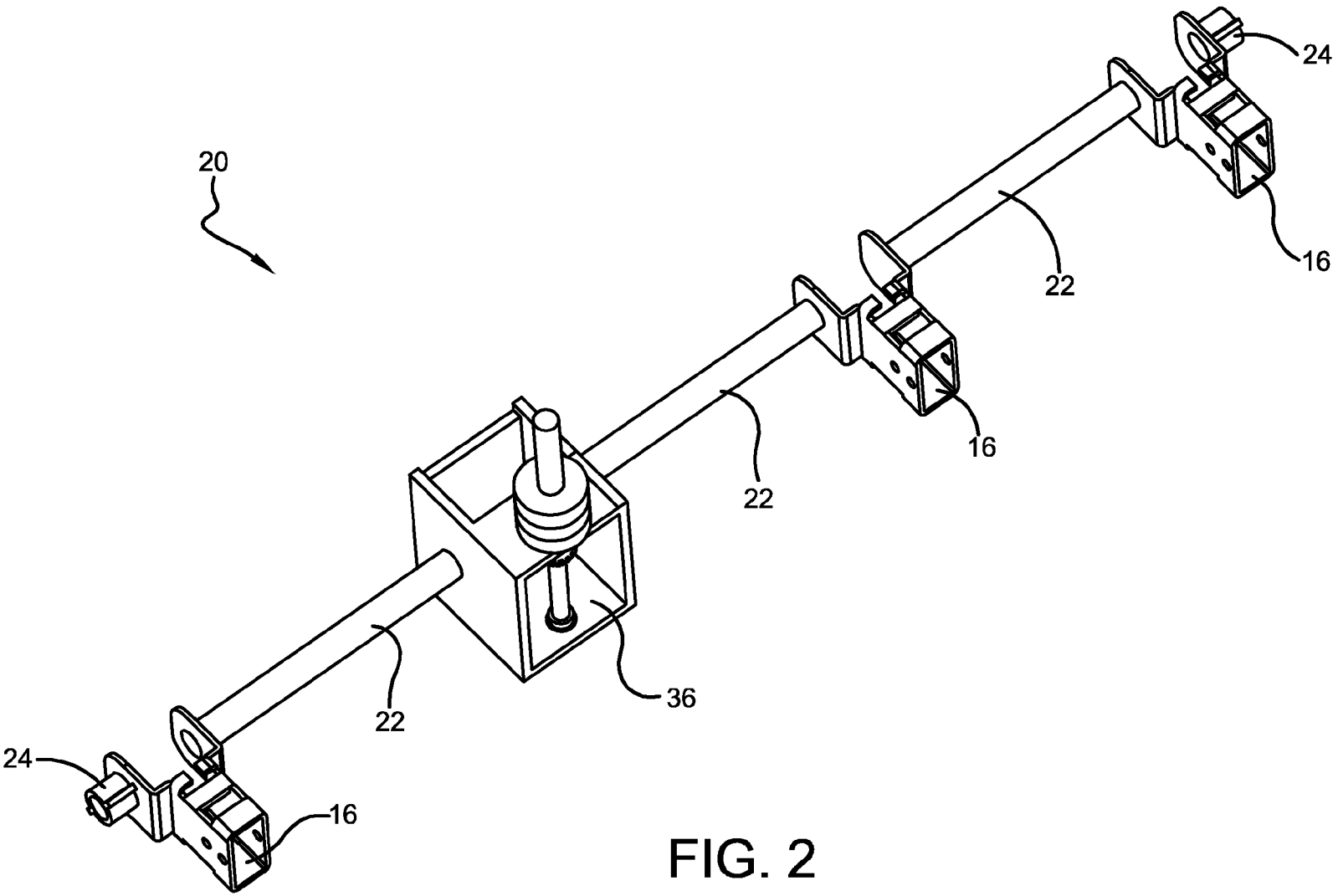
FIG. 2 is an isometric view of a geared drive assembly of the grounding switch embodied in accordance with the present invention.
Figure 3:
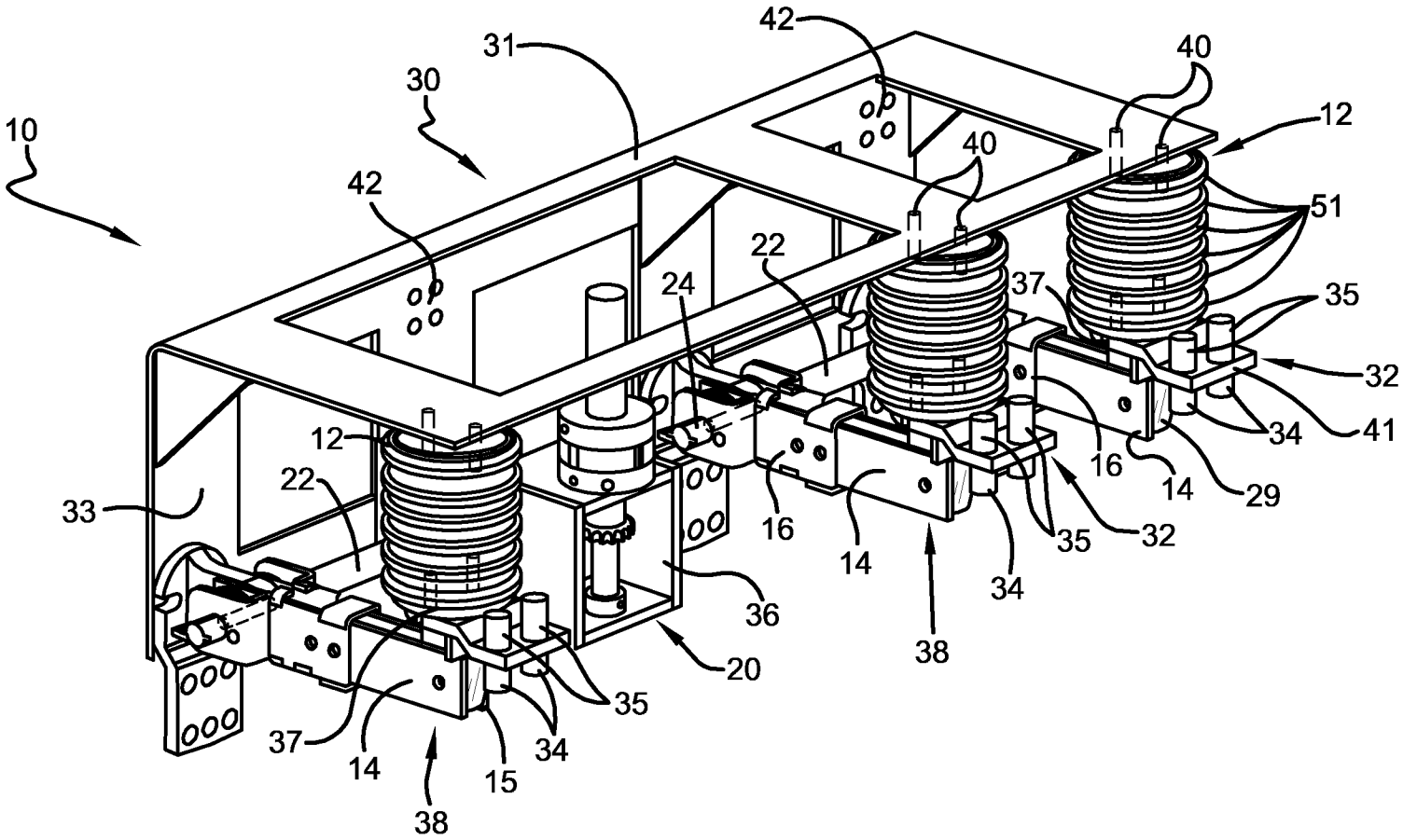
FIG. 3 is an isometric view of the grounding switch wherein the at least one first contact and the at least one second contact are depicted in a closed position.
Figure 4:
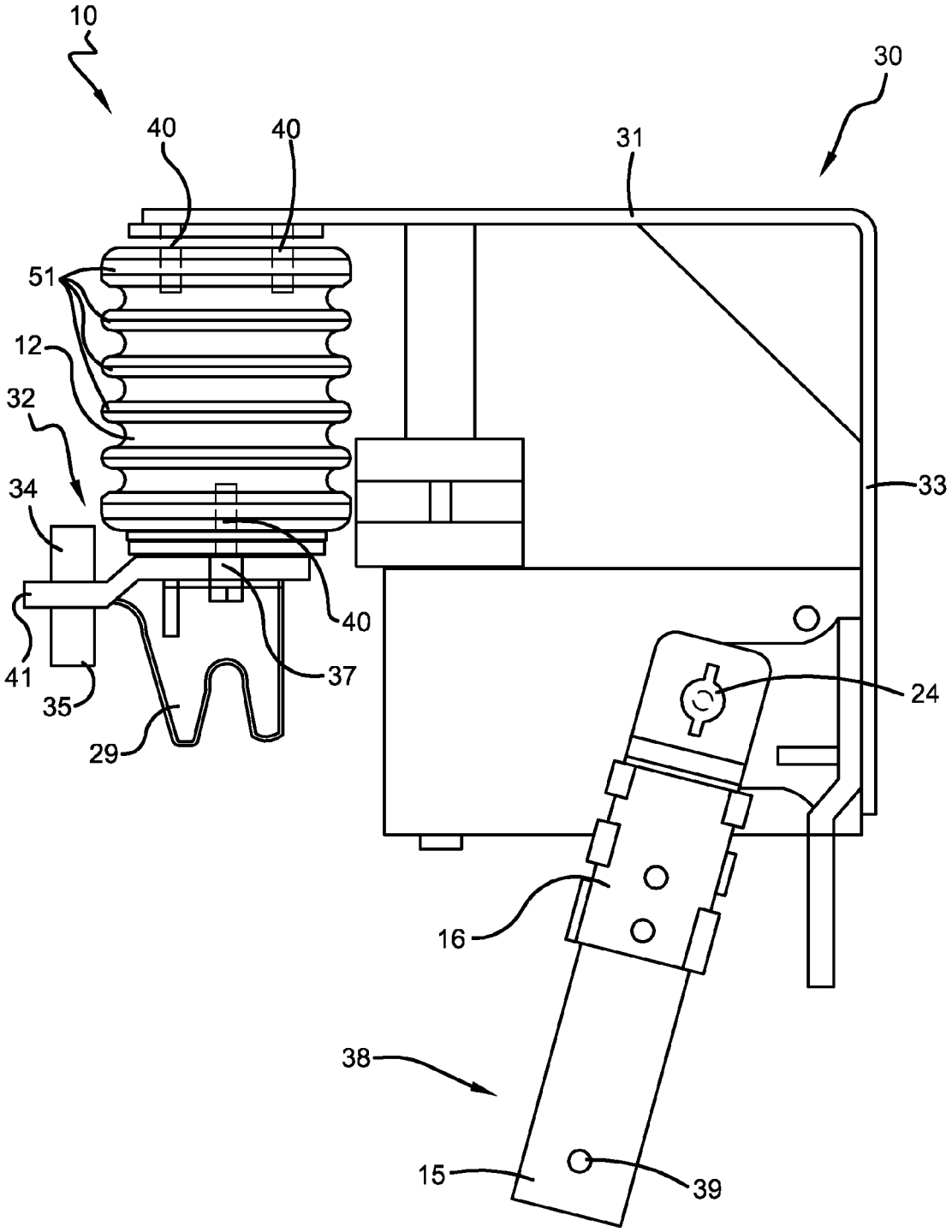
FIG. 4 is a right side view of the grounding switch wherein the at least one first contact and the at least one second contact are depicted in an open position.
Figure 5:
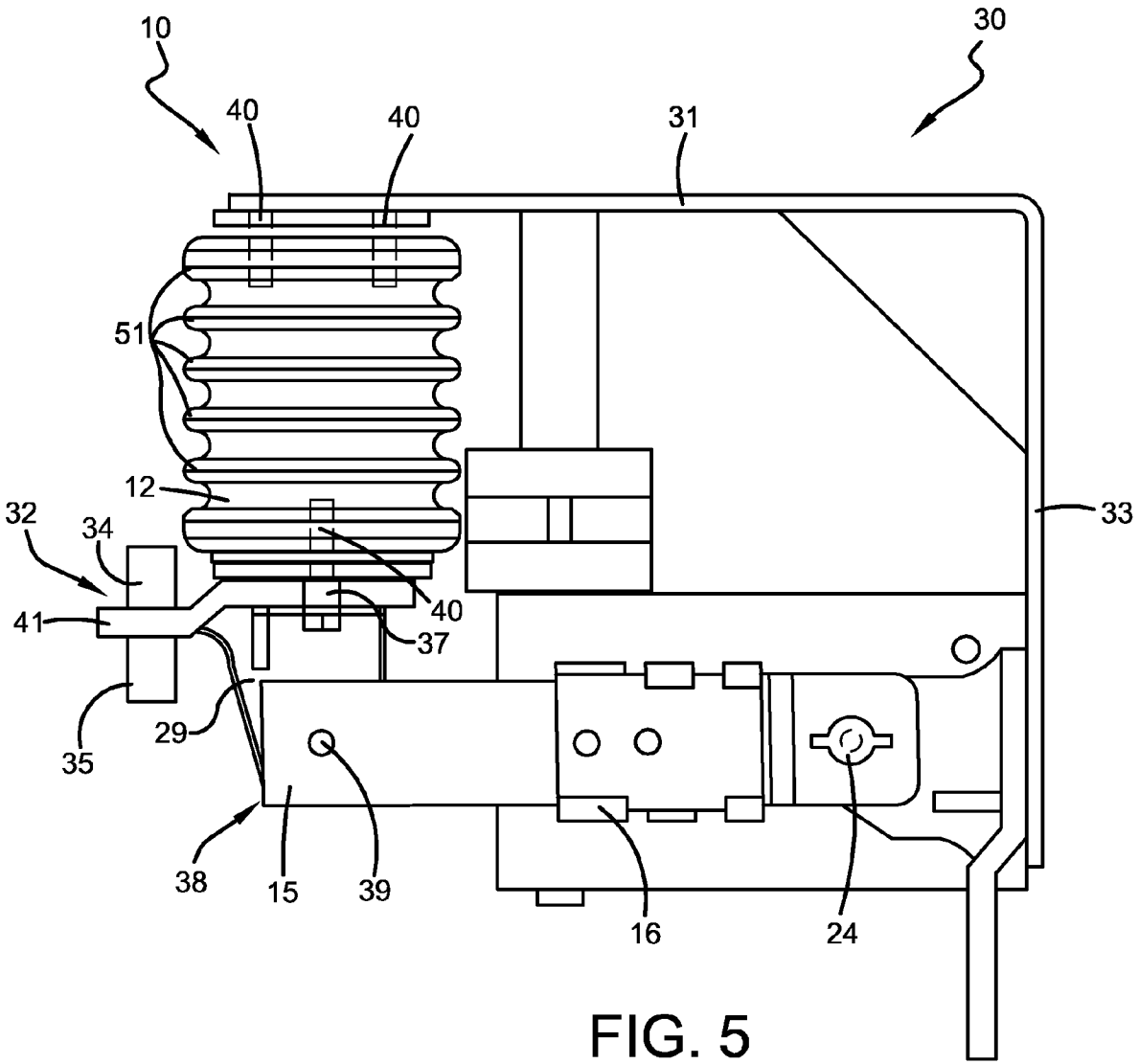
FIG. 5 is right side view of the grounding switch wherein the at least one first contact and the at least one second contact are depicted in a closed position.

Referring now also to FIG. 2, the first and second blades 14, 15 are mounted to at least one mount 16 that provides the support necessary to firmly hold the first and second blades 14, 15 in place while the grounding switch 10 moves between an open and a closed position. The at least one mount 16 is further secured to the at least one connecting rod 22 using keyed plugs 24. The keyed plugs 24 are comprised of generally arcuate connection pieces having flanges extending outwardly from and laterally across an outer surface of the keyed plug 24. The keyed plugs 24 are used to connect the at least one connecting rod 22 to the at least one mount 16 and/or a geared drive box 36. The at least one mount 16 provides the control and support necessary to rotate the at least one second contact 38 around the axis of the at least one connecting rod 22 as the grounding switch 10 moves between an open and a closed (grounded) position. The geared drive box 36, the at least one mount 16, the at least one connecting rod 22 and the keyed plugs 24 together comprise the geared drive assembly 20.

Referring now also to FIG. 6, the geared drive assembly 20 comprises a pair of bevel gears and is operated using an attached handle 18. The handle 18 includes a shaft that is disposed perpendicular to the at least one connecting rod 22. The bevels translate the rotation of the shaft into rotation of the at least one connecting rod 22. Rotation of the at least one connecting rod 22, in turn, moves the first and second contacts 32, 38 between the open and closed positions. The handle 18 is used to open and close the grounding switch 10. When the handle 18 is turned in a direction that causes the first and second contacts 32, 38 of the grounding switch to open, the second contacts 38 rotate about 90 degrees around the axis of the at least one connecting rod 22 until the first and second blades 14, 15 are positioned about perpendicular to the axis of the at least one connecting rod 22. One having ordinary skill in the art will appreciate that the at least one second contact 38 may be rotated about 30 degrees, about 60 degrees, or another angle around the axis of the at least one connecting rod 22 in other embodiments of the grounding switch 10. When the handle 18 is turned in a direction that causes the first and second contacts 32, 38 of the grounding switch 10 to close, the at least one second contact 38 is rotated about 30 degrees, about 60 degrees, about 90 degrees or another angle about the axis of the at least one connecting rod 22 until the at least one second contact 38 is in full contact with the at least one first contact 32.

During normal operation of the transformer 80, the first and second contacts 32, 38 of the grounding switch 10 remain open, with the first and second blades 14, 15 pointing generally downward in relation to the axis of the at least one connecting rod 22. The first and second contacts 32, 38 of the grounding switch 10 are typically moved to a closed position to ground the transformer 80 during maintenance, a power failure, or any other event that requires a grounded connection.

The geared drive assembly 20 may be embodied for use in a grounding switch 10 provided for a single-phase or a poly-phase transformer 80. The poly-phase embodiment of the geared drive assembly 20 is depicted in FIG. 2 wherein the closest ones of the at least one mount 16 to the geared drive box 36 are connected to the geared drive box 36 by a single connecting rod 22, while the far mount 16 is connected to the drive box by two connecting rods 22 and an adjacent one of the at least one mount 16. In a single-phase embodiment of the grounding switch 10, the geared drive assembly 20 may have only one of the at least one mount 16 and one of the at least one connecting rod 22, wherein the one mount 16 is connected to the geared drive box 36 by one connecting rod 22.

While the present application illustrates various embodiments, and while these embodiments have been described in some detail, it is not the intention of the applicant to restrict or in any way limit the scope of the appended claims to such detail. Additional advantages and modifications will readily appear to those skilled in the art. Therefore, the invention, in its broader aspects, is not limited to the specific details, the representative embodiments, and illustrative examples shown and described. Accordingly, departures may be made from such details without departing from the spirit or scope of the applicant's general inventive concept.

What is claimed is:

1. A grounding switch for a power distribution device, comprising:

a structural frame:

at least one spacer connected to the structural frame;

at least one switch connected to the at least one spacer, each switch comprising first and second contacts, said first contact connected to a first and a second high-voltage lead, said first high-voltage lead further connected to a high-voltage bushing and said second high-voltage lead further connected to a high-voltage coil of said power distribution device;

a drive assembly disposed inside said grounding switch structural frame and operably connected to the at least one switch to move the at least one switch between open and closed positions, the drive assembly comprising:

at least one rod;

a drive shaft;

a drive box connected between the drive shaft and the at least one rod and operable to translate rotation of the drive shaft into rotation of the least one rod;

at least one mount secured to the at least one rod, the at east one mount holding the second contact of each switch; and wherein rotation of the at least one rod causes the second contact of each switch to pivot and thereby move each switch toward the open position or the closed position with respect to said first contact, said switch closed position grounding the power distribution device through a connection between a grounded wall of the power distribution device and the at least one second contact.

2. The grounding switch of claim 1 wherein said structural frame is further comprised of at least one wall of a transformer enclosure.

3. The grounding switch of claim 1 wherein said structural frame is further comprised of a lid of a transformer enclosure.

4. The grounding switch of claim 1 wherein when a handle attached to said grounding switch is operated, said at least one second contact of said grounding switch move into or out of contact with said at least one first contact.

5. The grounding switch of claim 1 wherein the movement of said at least one second contact to an open position with respect to said at least one first contact opens the circuit of an electrical device integrated with said grounding switch.

6. The grounding switch of claim 1 wherein the at least one first contact is comprised of a flat metal plate having at least one first opening and at least one second opening and a forked extension portion wherein the forked extension portion extends perpendicularly from a bottom planar surface of the flat metal plate toward the base of an enclosure of a transformer.

7. The grounding switch of claim 1 wherein the at least one second contact is comprised of a first blade and a second blade, said first and second blades connected together using a bolt, a first spring placed on an outer surface of said first blade and a second spring placed on an outer surface of a second blade, said first and second blades maintained at a set distance with respect to one another, said first and second blades suitable for receiving a forked extension portion of said at least one first contacts.

8. The grounding switch of claim 1 wherein the power distribution device is a dry-type transformer.

9. A transformer, comprising:

a ferromagnetic core comprising at least one limb extending between a first and a second yoke;

at least one coil assembly mounted to the at least one limb, said at least one coil assembly having a high-voltage coil and a low-voltage coil, said high-voltage coil having a high-voltage lead extending therefrom and in connection with a first contact of a grounding switch;

an enclosure having at least one wall at ground potential, a lid, and a base;

a bushing extending from said enclosure and in connection to the grounding switch first contact; and the grounding switch connected to an interior surface of said enclosure at least one wall, said grounding switch having at least one switch comprising the first and a second contact, and a drive assembly, said drive assembly comprising:

at least one rod;

a drive shaft;

a drive box connected between the drive shaft and the at least one rod and operable to translate rotation of the drive shaft into rotation of the least one rod;

at least one mount secured to the at least one rod, the at least one mount holding said second contact, said grounding switch operable to connect said transformer to ground potential when said second contact of said grounding switch is moved into engagement with said first contact of said grounding switch.

10. The transformer of claim 9 wherein said grounding switch is further comprised of a geared drive box, at least one mount, at least one connecting rod connecting said at least one mount to said geared drive box, at least one first contact and at least one second contact.

11. The transformer of claim 10 wherein said at least one first contact is attached to at least one wall of said enclosure and said at least one second contact is attached to said at least one mount.

12. The transformer of claim 10 wherein said at least one first contact is attached to at least one spacer, said at least one spacer attached to a structural frame.

13. The transformer of claim 10 wherein said at least one second contact moves around an axis of said at least one connecting rod, when said grounding switch is operated to move said at least one second contact into a closed or an open position with respect to said at least one first contact.

14. The transformer of claim 9 wherein said transformer is a dry-type transformer.

15. A method of forming a transformer, comprising:

a. providing a ferromagnetic core comprising at least one limb extending between first and second yokes;

b. mounting at least one coil assembly to the at least one limb, said at least one coil assembly having a high-voltage coil in connection with a first contact of a grounding switch and a low-voltage coil:

c. placing said ferromagnetic core and said at least one coil assembly into an interior space of an enclosure, said enclosure having at least one wall, a base and a lid, said lid having a bushing extending therefrom, said bushing in connection with said grounding switch first contact; and d. mounting a grounding switch to a grounded wall of said enclosure interior space, said grounding switch operable to connect said transformer to ground potential when contacts of said grounding switch are closed by operating a drive assembly of said grounding switch to pivot a second contact of each switch and thereby move each switch toward the open position or the closed position, said switch dosed position grounding the power distribution device through a connection between a grounded wall of the power distribution device and said second contact and said first contact.

16. The method of claim 15 wherein said grounding switch is comprised of a compact geared drive assembly connected to at least one first contact and at least one second contact, said geared drive assembly operable to open and close said at least one second contact with respect to said at least one first contact when said compact geared drive assembly is activated.

* * * * *